United States Patent [19]

Soltermack

[11] Patent Number: 4,706,462

[45] Date of Patent: Nov. 17, 1987

[54] METHOD FOR DRIVING AN ENGINE

[75] Inventor: Gilbert W. Soltermack, Bayview, Tex.

[73] Assignee: Jim L. De Cesare, Houston, Tex.

[21] Appl. No.: 917,841

[22] Filed: Oct. 14, 1986

[51] Int. Cl.[4] ..... F01B 29/04

[52] U.S. Cl. ..... 60/712; 123/25 P; 123/41.2

[58] Field of Search ..... 60/712; 123/25 P, 25 C, 123/41.2, 39

[56] References Cited

U.S. PATENT DOCUMENTS

| | | | |
|---|---|---|---|
| 752,619 | 2/1904 | Gardner | 60/712 |
| 4,253,431 | 3/1981 | Mettig et al. | 123/41.2 |
| 4,322,950 | 4/1982 | Jepsen | 60/712 |
| 4,377,934 | 3/1983 | Marshall | 60/712 |
| 4,417,447 | 11/1983 | Thomas | 60/712 |
| 4,433,548 | 2/1984 | Hallstrom | 60/712 |

*Primary Examiner*—Craig R. Feinberg
*Assistant Examiner*—M. Macy
*Attorney, Agent, or Firm*—Jim L. De Cesare

[57] ABSTRACT

A method is described wherein the efficiency of an internal combustion engine is upgraded. Heat from the engine block is used to generate high pressure steam. The steam is generated in a chamber separate from and in addition to the standard engine cooling system water jacket. The high pressure steam is fed to a selected one of the engine pistons and used to drive that piston in an otherwise alternating pattern with the combustion stroke. The steam drive and the combustion drive for the selected piston alternate one with respect to the other.

12 Claims, 3 Drawing Figures

METHOD FOR DRIVING AN ENGINE

BACKGROUND

In an internal-combustion engine, a combustible material, a fuel, usually some kind of petroleum product, is made to burn rapidly at the top of a chamber called a cylinder. Engines can have anywhere from 1 to 12 or more cylinders and automobile engines typically have 6 or 8. The explosive burning of the fuel produces hot gases, which expand and push a mass of metal, called a piston, down the cylinder. A system of rods and shafts in the engine uses the work done by pushing down the cylinder to spin a crankshaft. This spinning can then be applied to do other work, such as turning the wheels of a motor vehicle.

To make an engine operate continuously, the piston has to be returned to its original position at the top of the cylinder. Not only that, but the hot exhaust gases have to be expelled, fresh air brought back in, and new fuel supplied.

The pistons are attached by way of a connecting rod to the crankshaft. The crankshaft is not straight but contains a series of U-shaped bends through which the back-and forth motion of the piston rod is converted into rotary motion. When the piston reaches the bottom of the cylinder and the rod is fully extended, the rotating crankshaft pushes it all the way up to the top again.

At the top of each cylinder are two valves. An exhaust valve lets the burnt gases out after they have pushed the piston all the way down, and an intake valve lets in fresh air and new fuel. These valves open and shut with the aid of a system of rods and springs that operates according to the commands of a spinning shaft, camshaft, which is in turn driven by the crankshaft.

The engine ordinarily used in an automobile is a four-stroke engine. During one cycle, each piston moves back and forth twice, completing four strokes.

In the first, or intake, stroke, the piston moves from the top of the cylinder to the bottom. During this stroke, air and fuel are drawn into the cylinder through the open intake valve. In the second, or compression stroke, the piston moves up to the top of the cylinder. Both valves are closed, and the fuel mixture is compressed. At the end of the stroke, the fuel mixture is ignited by an electric spark or spontaneously by the heat inside the cylinder.

The resulting explosion creates hot, expanding gases that drive the piston back down the cylinder. This is called the power stroke. During the exhaust stroke, the piston returns to the top of the cylinder, pushing the gases out through the open exhaust valve.

In ordinary gasoline-powered engines, the fuel is fed into the carburetor, where it is mixed with air before entering the cylinder. This mixture is then ignited by a spark created by a spark plug. In diesel engines, the fuel is sprayed directly into the cylinder (called fuel injection). The heat generated when the air inside the cylinder is compressed during the upstroke of the piston ignites the diesel fuel spontaneously.

In an automobile engine, combustion temperatures are extremely high, for example, to 6000° F. This heat and the heat caused by the friction of moving parts must be dissipated. In a water cooled engine, water is circulated in jackets or pockets that surround the cylinder walls and the cylinder heads. The water carries away the heat from the engine to a radiator. The radiator dissipates the heat by the air that circulates past the radiator. A water pump driven by a belt keeps the water in circulation along a closed loop including the radiator,engine, and the passenger compartment heater. In a standard vehicle internal combustion engine, the engine dissipates about 60 percent of the heat it generates, and converts only the remaining 40 percent to mechanical energy for driving the car. Thus, it can be seen that a substantial portion of potential heat energy is being wasted.

SUMMARY

This invention relates to a method of utilizing more of the heat generated by an internal combustion engine for the purpose of driving the car. Heat energy generated by the engine and heretofore dissipated is according to the present invention converted to steam energy for driving the car. Specifically, heat in the engine block is used to produce steam and the steam is employed to drive a selected piston at a selected time.

A method is described herein wherein the efficiency of an internal combustion engine is upgraded. Heat from the engine block is used to generate high pressure steam. The steam is generated in a chamber separate from and in addition to the conventional engine cooling system water jacket. The high pressure steam is fed to a selected one of the engine pistons and used to drive that piston in an otherwise alternating pattern with the combustion stroke. The steam drive and the combustion drive for the selected piston alternate one with respect to the other. Thus, the invention provides a method of improving the overall efficiency of an internal combustion engine including the steps of collecting heat generated in the engine block separately of the engine cooling system, producing high pressure steam with the collected heat, selectively driving at least one piston of the engine with the high pressure steam while simultaneously deactivating the combustion drive for the said one piston, selectively de-activating the steam drive for the said one piston while simultaneously re-activating the combustion drive for the said one piston once again.

DRAWINGS

DESCRIPTION

Figure 1:
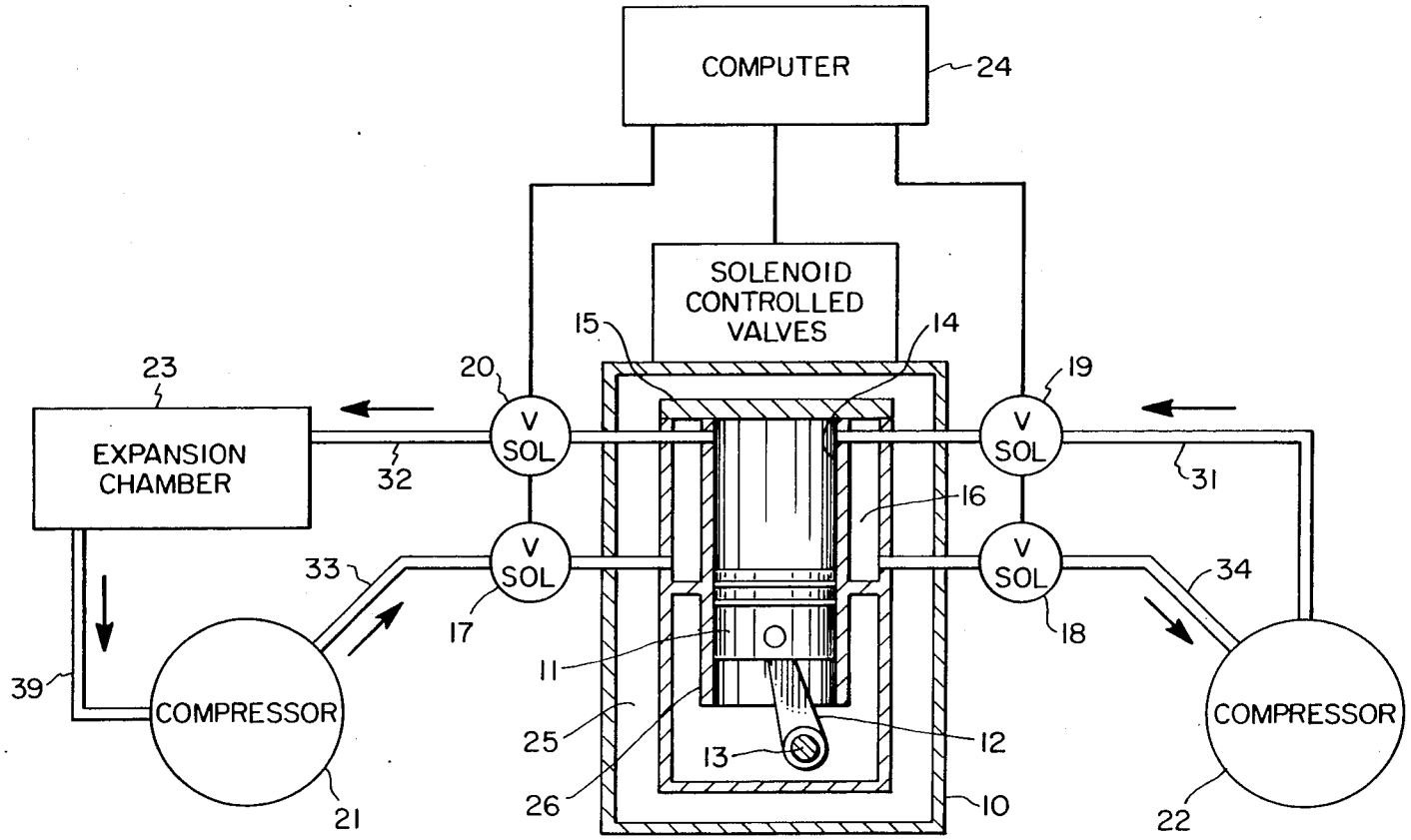
FIG. 1 is a functional representation of a system employed for carrying out the method of the present invention.
Figure 2:
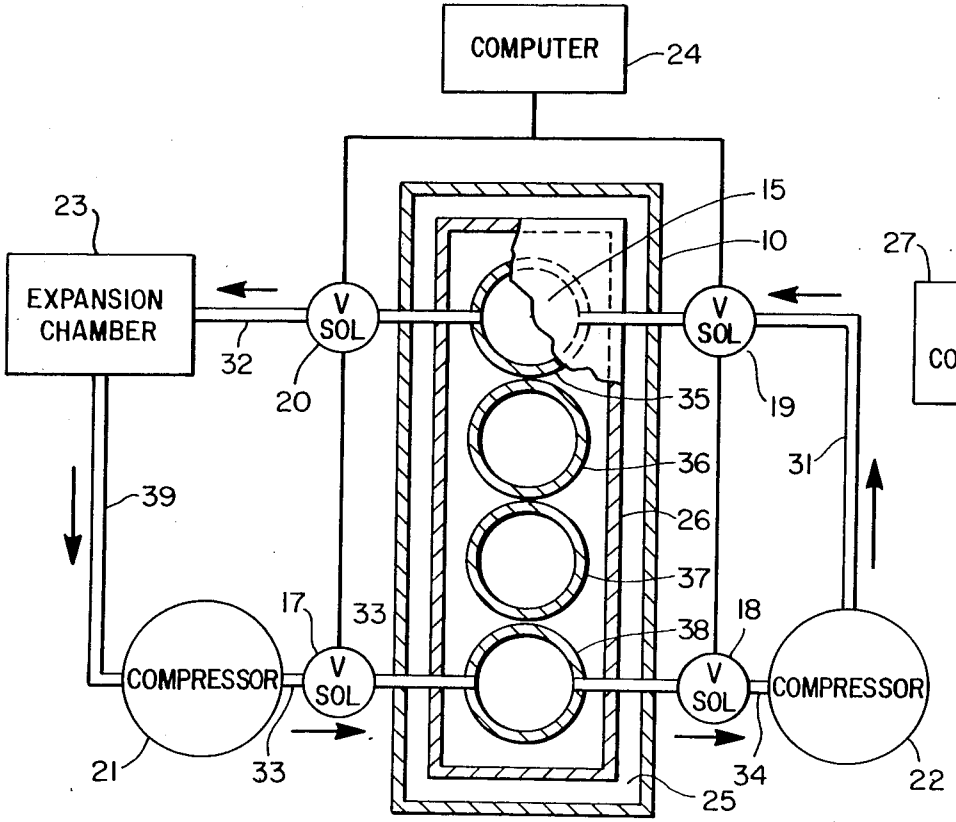
FIG. 2 is a top view of the system of FIG. 1.

In FIGS. 1 and 2 there will be seen apparatus for carrying out the method of the present invention. Typically, a motor vehicle internal combustion engine includes a water jacket 25 that surrounds the engine block 10 in order to carry away and to dissipate the heat collected from the engine as it operates. In addition to the standard water or cooling jacket 25, the present invention provides a separate and distinct high pressure steam cavity or chamber 16 in surrounding relationship to the piston 11, cylinder 14, and the cylinder head 15 of the auto engine. The connecting rod 12 and the crankshaft 13 are otherwise below cavity 16.

Figure 3:
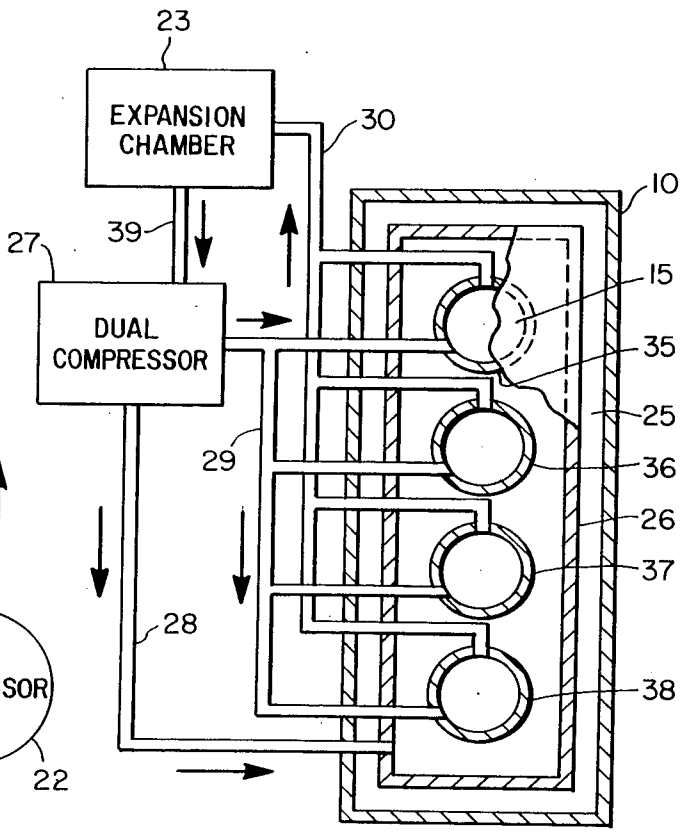
FIG. 3 is an alternate embodiment of the system depicted in FIGS. 1–2 and employed in instances where more than a single piston is desired to be steam driven in accordance with the method of the present invention.

Cavity 16 communicates with a pair of compressors 21–22 as well as an expansion chamber 23 by means of a series of solenoid actuated valves 17–20 each of which is controlled by a microprocessor 24. Suitable ports are provided in the cylinder wall 14 and in the internal high pressure chamber wall 26 for this purpose. In FIGS. 1–2 only a single piston 11 is shown to be in communication with cavity 16, although the system of FIG. 3 illustrates the connections wherein it is desired to communicate each of the four pistons of the engine with cavity 16. The embodiment of FIG. 3 is otherwise identical to that of FIGS. 1–2 except that in FIG. 3 a dual compressor unit 27 may be used instead of two units as in FIGS. 1–2. The line 28 is a return passage between compressor 27 and cavity 16, line 29 is the high pressure intake passageway for the pistons and line 30 is the exhaust line. Similarly, in FIGS. 1–2, line 31 feeds high pressure steam to drive piston 11; line 32 is the piston drive exhaust line; and lines 33 and 34 respectively return and feed steam from the cavity 16.

In the preferred embodiment, the piston 11 will fire either from a gasoline drive or a steam drive. Computer 24 measures the steam volume sufficient to downstroke piston 11 with a force equivalent to the combustion pressure, and controls valves 17–20 accordingly, however, a steam drive is not affected until the steam pressure in line 31 is equal to or greater than the gasoline combustion pressure. However, at such time, microprocessor 24 de-activates the gasoline feed to piston 11 and effects the downstroke of the piston with the equivalent steam force in line 31. Thereafter, the gasoline feed is resumed and the steam drive terminated. In FIG. 3, at such time as the steam pressure in line 29 is at the desired level, computer 24 selects one of the four cylinders 35–38 approaching the end of the exhaust cycle and closes the gasoline intake valve to that cylinder while simultaneously opening the cylinder to the steam pressure. Computer 24 maintains the gasoline exhaust valve closed and opens the steam exhaust valve in order to evacuate the cylinder to the expansion chamber 23. The computer 24 thereafter returns that cylinder to the gasoline combustion drive and terminates the steam drive pending the availability of high pressure steam again in line 29. Thus, microprocessor 24 functions to carry out all the data processing in order to select the proper cylinder that is next to be fired; determines the point at which the steam pressure is at the required level; and controls all of the steam and gasoline intake and exhaust valves in order to switch between the combustion drive and the steam drive. In cases where the engine is diesel, the computer 24 controls the injectors rather than the intake and exhaust valves. Computer 24 therefore utilizes heat that would be otherwise dissipated and employs it to produce steam that is employed to drive a selected piston. In some instances, an oil filter may be required before the fluid is allowed to be recirculated within the closed system, in order to remove any moisture. Further, a filter may be required in some cases in line 39 to free the fluids therein of oil. It should be noted that the volume of the expansion chamber 23 is to be selected to be equal to the volume of the cylinder in order to reduce any back pressure that occurs during the cylinder exhaust cycle. Hence, microprocessor 24 selects the proper piston to fire when the steam pressure developed by compressor 22 is equal to the combustion pressure required to downstroke the piston. Fuel injector lines are then closed and the steam line is opened to downstroke the piston. The injector exhaust line is de-activated and the steam exhaust solenoid is actuated allowing spent steam to be forced into chamber 23. Solenoids 19 and 20 are closed and the injector intake and exhaust ports are placed in operation once again resuming the combustion drive for that piston.

In the preferred embodiment of the present invention it is an essential feature thereof that the microprocessor 24 measure a volume of steam in lines 29 and 31 that is sufficient to down stroke the piston 11 with a force equivalent to one gasoline combustion cycle. It is also a function of the computer 24 to time the closing of the gasoline intake and exhaust valves prior to the steam injection cycle. These valves are re-activated at the end of the steam cycle. The computer 24 also times the opening and closing of the solenoid valves 17–20 in order to effect the steam drive phase of the process. Further, computer 24 insures that a steam drive cycle is not initiated until the steam pressure in lines 29 and 31 is at the proper level. Since the pistons in cylinders 35-38 are driven one at a time in the steam phase, it is necessary that microprocessor 24 select the next cylinder in each instance that is to fire and to close off the gasoline combustion cycle and initiate the steam phase. As noted above, this occurs as each cylinder approaches the end of an exhaust cycle. While the drawings illustrate a four cylinder engine, this is exemplary only and the concepts herein are applicable to engines with six, eight, or twelve cylinders for example. In addition, the concepts herein are applicable to reciprocating as well as rotary engines whether they be gasoline or diesel powered.

It will be apparent from the foregoing that many other variations and modifications may be made in the structures and methods described herein without departing substantially from the essential concept of the present invention. Accordingly, it should be clearly understood that the forms of the invention described herein and depicted in the accompanying drawings are exemplary only and are not intended as limitations in the scope of the present invention.

What is claimed is:

1. The method of improving the overall efficiency of an internal combustion engine having at least one piston, cylinder walls, a combustion drive cycle, an engine block, and an engine cooling system including a jacket surrounding the cylinder walls and piston, comprising the steps of collecting heat generated in the engine block in a separate chamber located interiorly of the cooling jacket, producing high pressure steam in the separate chamber with the collected heat, selectively driving at least one piston of the engine with the high pressure steam while simultaneously de-activating the combustion drive for said piston, selectively deactivating the steam drive for said piston while simultaneously re-activating the combustion drive for said piston and using a microprocessor to selectively de-activate the combustion and steam drives, and to selectively re-activate the combustion and steam drives, delaying with the microprocessor the steam drive until the steam pressure in the chamber is at least equal to pressure of combustion from gasoline selecting with the microprocessor one of a plurality of cylinders next to be fired, determining with the microprocessor a point at which the steam pressure in the chamber is at least equal to the gasoline combustion pressure, and controlling with the microprocessor switching of the switching of the selected cylinder between the combustion drive and the stream drive, passing exhaust steam from the cylinder to an expansion chamber having a volume which is at least equal to that of the cylinder in order to reduce any back pressure that occurs during each exhaust cycle of the cylinder, compressing the steam from the expansion chamber in two stages and returning the compressed steam to the cylinder.

2. The method of improving the overall efficiency of an internal combustion engine having at least one piston, cylinder walls, a combustion drive cycle, an engine block, and an engine cooling system including a jacket surrounding the cylinder walls, and piston, comprising the steps of collecting heat generated in the engine block in a separate chamber located interiorly of the cooling jacket, producing high pressure steam in the separate chamber with the collected heat, selectively driving at least one piston of the engine with the high pressure steam while simultaneously de-activating the combustion drive for said piston, selectively de-activating the steam drive for said piston while simultaneously re-activating the combustion drive for said piston and using a microprocessor to selectively de-activate the combustion and steam drives, and to selectively re-activate the combustion and steam drives.

3. The method of claim 2 including the step of delaying with the microprocessor the steam drive until the steam pressure in the chamber is at least equal to pressure of combustion from gasoline.

4. The method of claim 3 including the step of selecting with the microprocessor one of a plurality of cylinders next to be fired, determining with the microprocesor a point at which the steam pressure in the chamber is at least equal to the gasoline combustion pressure, and controlling with the microprocessor switching of the selected cylinder between the combustion drive and the steam drive.

5. The method of claim 4 including the step of passing exhaust steam from the cylinder to an expansion chamber having a volume which is at least equal to that of the cylinder in order to reduce any back pressure that occurs during exhaust cycle of the cylinder.

6. The method of claim 5 including the step of compressing the steam from the expansion chamber in two stages, and returning the compressed steam to the cylinder.

7. The method of improving the overall efficiency of an internal combustion engine having at least one piston, cylinder walls, a combustion drive cycle, an engine block, and an engine cooling system including a jacket surrounding the cylinder walls and piston, comprising the steps of collecting heast generated in the engine block in a separate chamber located interiorly of the cooling jacket, producing high pressure steam in the separate chamber with the collected heat, selectively driving at least one piston of the engine with the high pressure steam while simultaneously de-activating the combustion drive for said piston, and selectively de-activating the steam drive for said piston while simultaneously re-activating the combustion drive for said piston.

8. The method of claim 7 including th e step of using a microprocessor to selectively de-activate the combustion and steam drives, and to selectively re-activate the combustion and steam drives.

9. The method of claim 8 including the step of delaying with the microprocessor the steam drive until the steam pressure in the chamber is at least equal to pressure of combustion from gasoline.

10. The method of claim 9 including the step of selecting with the microprocessor one of a plurality of cylinders next to be fired, determining with the microprocessor a point at which the steam pressure in the chamber is at least equal to the gasoline combustion pressure, and controlling with the microprocessor switching of the selected cylinder between the combustion drive and the steam drive.

11. The method of claim 10 including the step of passing exhaust steam from the cylinder to an expansion chamber having a volume which is at least equal to that of the cylinder in order to reduce any back pressure that occurs during each exhaust cycle of the cylinder.

12. The method of claim 11 including the step of compressing the steam from the expansion chamber in two stages, and returning the compressed steam to the cylinder.

* * * * *